United States Patent [19]

Geary

[11] Patent Number: 4,811,817

[45] Date of Patent: Mar. 14, 1989

[54] SELF-CONTAINED LADDER SYSTEM FOR A BOAT

[76] Inventor: Timothy C. Geary, 2201 Hemerick Pl., Clearwater, Fla. 34625

[21] Appl. No.: 194,946

[22] Filed: May 17, 1988

[51] Int. Cl.[4] ..... B63B 27/14

[52] U.S. Cl. ..... 182/76; 182/196; 114/362

[58] Field of Search ..... 182/76, 70, 196, 90; 114/362

[56] References Cited

U.S. PATENT DOCUMENTS

| | | | |
|---|---|---|---|
| 113,311 | 4/1871 | Laynor et al. . | |
| 203,077 | 4/1878 | Shaw . | |
| 335,372 | 2/1886 | Marcus et al. | 182/70 |
| 412,630 | 10/1889 | Klipp | 182/76 |
| 433,061 | 7/1890 | Aarons | 182/76 |
| 453,951 | 6/1891 | White . | |
| 1,123,029 | 12/1914 | Smith | 182/70 |
| 2,669,733 | 2/1951 | Picker . | |
| 2,971,601 | 2/1961 | Fortune . | |
| 2,990,908 | 7/1961 | Wozniak | 182/70 |
| 3,183,998 | 5/1965 | Major . | |
| 3,584,704 | 6/1971 | Eckmann . | |
| 3,774,720 | 11/1973 | Hovey . | |
| 3,794,140 | 4/1974 | Sell . | |
| 4,146,941 | 4/1979 | Haslam . | |
| 4,445,589 | 5/1984 | Longnecker . | |
| 4,669,414 | 6/1987 | Molino . | |

FOREIGN PATENT DOCUMENTS

| | | |
|---|---|---|
| 1077096 | 9/1958 | Fed. Rep. of Germany . |
| 2752289 | 5/1979 | Fed. Rep. of Germany . |
| 1478704 | 6/1977 | United Kingdom . |

OTHER PUBLICATIONS

"Yachting", Apr. 1958, vol. 103, No. 4, p. 94.

*Carpco*, "The Australian Boarding Stage" (pamphlet).

*Primary Examiner*—Reinaldo P. Machado

*Attorney, Agent, or Firm*—Wall and Roehrig

[57] ABSTRACT

A hidden ladder unit for mounting in the stern of a boat hull that includes a horizontally disposed housing affixed to the transom that has an open front wall and a solid back wall. The housing is equipped with a mounting flange that is fastened securely to the transom. A foldable ladder is secured in the back wall of the housing which, when folded, is fully contained within the housing, and when extended, hangs downwardly from the transom to the waterline of the hull. The opening formed in the front wall of the housing is closed by means of a door that is hingedly mounted in said housing.

9 Claims, 1 Drawing Sheet

SELF-CONTAINED LADDER SYSTEM FOR A BOAT

BACKGROUND OF THE INVENTION

This invention relates to a boat ladder, and in particular to a collapsible boat ladder that is capable of being fully stowed within the transom of a boat hull.

As described in U.S. Pat. Nos. 2,971,601; 3,794,140; and 3,774,720 boat ladders have been devised for mounting on the outside of a boat transom to assist boaters into and out of the water. Typically, these ladder systems are equipped with some type of mechanism that permits the ladder to be folded into a more compact unit when not in use. Even when folded, however, these ladder units usually project some distance from the rear of the boat. Accordingly, the ladder can snag foreign objects or strike against docks, pilings and the like, thereby causing damage not only to the ladder system, but also to the hull of the boat.

A retractable step for use in a small pleasure craft is further disclosed by Eckmann in U.S. Pat. No. 3,584,704. The unit is mounted in the bottom portion of a boat hull and contains a vertically disposed housing which opens through the hull below the water line. A U-shaped step is retractably contained within the housing with the ring of the step projecting through the housing opening. When a swimmer wishes to enter the boat, the step is extended to provide a platform upon which the swimmer can stand and thus more easily climb into the boat. Although the single step system is very helpful to permit a swimmer to enter a relatively small boat, it provides little or no aid to a boater who wishes to climb from the boat into the water. The retractable step of the Eckmann device is also objectionable because is opens below the water line and can thus provide a means by which water can leak into the hull. Because the ring of the step projects from the hull it provides unwanted drag and can snag underwater objects as the boat moves through the water. The single step device is of little or no use when used in conjunction with larger boats. Lastly, the ladder parts are continuously exposed to moisture and thus susceptible to rapid corrosion or becoming fouled with waterborne contaminants.

U.S. Pat. Nos. 4,146,941 and 2,669,733 both describe bow ladder units which are attached to the front of a small boat to aid the boater in getting in and out of the water. These devices are generally unsightly structures that detract from the boat lines and are highly susceptible to becoming damaged or destroyed in the event the boat strikes a dock, piling or the like.

SUMMARY OF THE INVENTION

It is therefore an object of the present invention to improve apparatus for assisting a boater in entering and leaving the water from a boat.

A still further object of the present invention is to provide a collapsible ladder for use in a relatively large boat that will allow the boater to conveniently and safely enter and leave the water.

A still further object of the present invention is to provide a multiple step ladder that is fully retractable in the stern of a boat so that the ladder can be safely stowed when not in use.

Another object of the present invention is to provide a stowable stern ladder for a boat that will not project beyond the transom when the ladder is placed in a stowed position.

These and other objects of the present invention are attained by means of a ladder system mounted in the transom of a boat that includes a horizontally disposed housing recessed within the transom above the water line of the boat hull. The housing has an open front wall and a solid back wall. A collapsible ladder is secured to the back wall of the housing which, when collapsed, is fully contained within the housing and which when extended, hangs downwardly from the transom below the water line. A hinged door is mounted in the housing opening which permits the housing to be closed when the ladder is stowed within the housing.

BRIEF DESCRIPTION OF THE DRAWINGS

For a better understanding of these and other objects of the present invention, reference shall be herein made to the following description of the invention which is to be read in conjunction with the associated drawings, wherein.

DETAILED DESCRIPTION OF THE INVENTION

Figure 1:
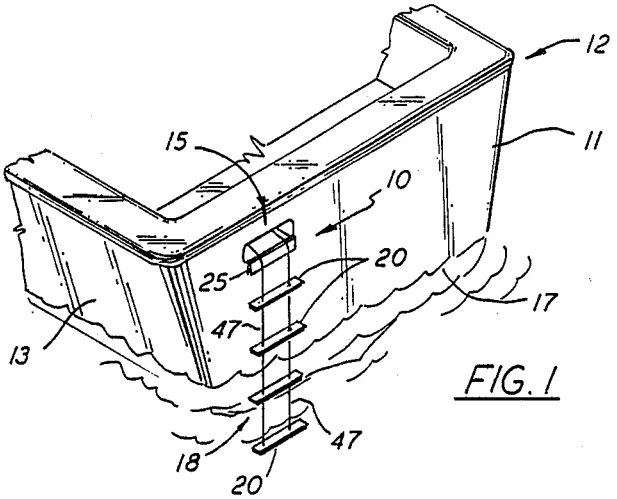
FIG. 1 is a partial perspective view of the stern section of a boat containing a stowable ladder unit embodying the teachings of the present invention showing the ladder suspended from a housing mounted in the stern of the boat.

As shown in the drawings, the apparatus of the present invention involves a hidden ladder unit, generally referenced 10, that is contained within the transom 11 of a boat 12 having a relatively large hull 13 that ordinarily makes it difficult for a boater to climb into and out of the boat. Boaters who like to water ski, scuba dive or simply swim from a pleasure craft oftentimes have difficulty getting in and out of the water, particularly where the boat rides high out of the water. Entry in and out of the boat is further made difficult when the swimmer is burdened with any kind of aquatic gear. Although the present ladder is ideally suited for use in pursuit of water related sports, it can also be used as a safety device to provide aid to a person who might have accidentally fallen overboard and is in need of rescue.

As illustrated in FIG. 1, the unit 10 includes a housing 15 mounted high in the transom of the boat, well above the water line 17. A foldable ladder 18 shown in an extended position suspended from the housing so that it hangs down into the water. The ladder contains a number of steps or rungs 20—20 that are spaced close enough together so that a person can easily climb the ladder when either entering or leaving the water. A door 25 is hinged to the housing which, as will be explained in greater detail below, can be closed and locked when the ladder is fully stowed within the housing.

Figure 4:
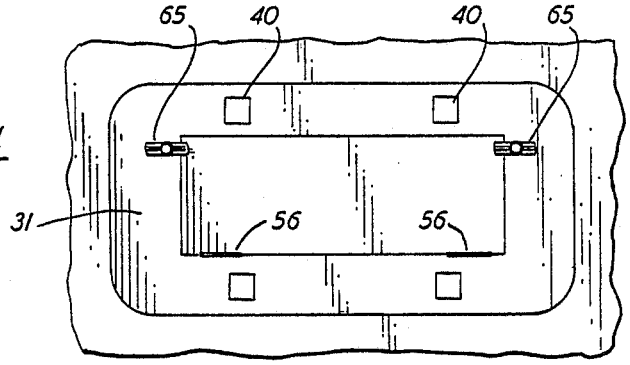
FIG. 4 is a partial front view of the housing with the door in a closed and locked position.
Figure 2:
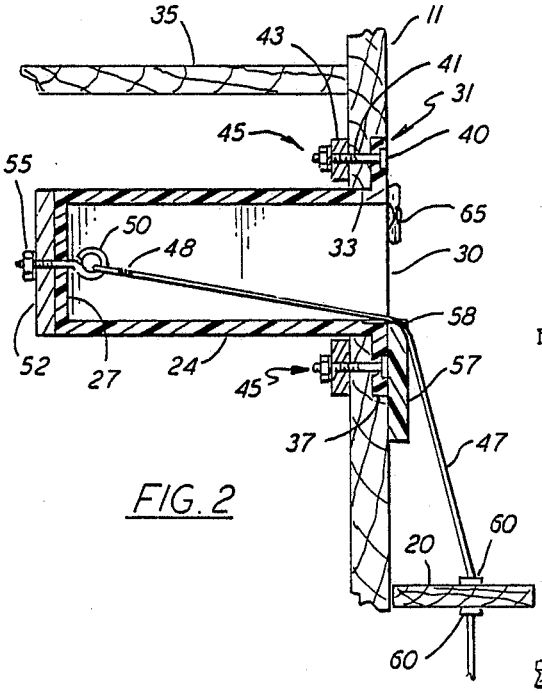
FIG. 2 is an enlarged partial side elevation in section showing the ladder housing in greater detail.
Figure 3:
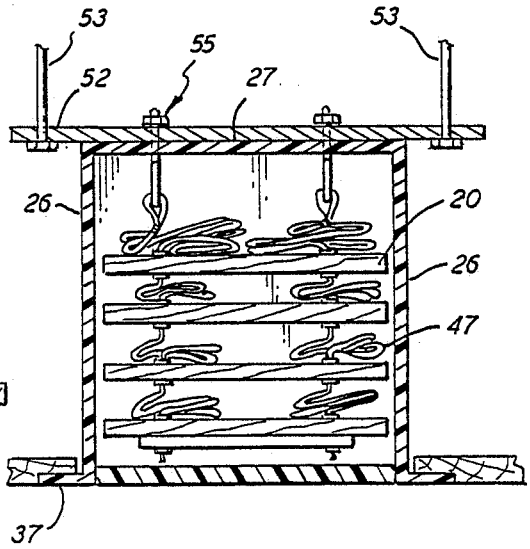
FIG. 3 is a top view in section showing the collapsible ladder stowed within the housing and the housing door in a closed position.

Turning now to FIGS. 2–4, housing 15 is generally rectangular in form having horizontally disposed side walls 26—26 that are confined to a closed back wall 27. The front wall 28 of the housing has an opening 30 therein and a radially extended flange 31. Preferably the housing is molded as a single piece unit from high strength plastic, or the like, or alternatively, cast from a corrosive resistant metal. A hole 33 is provided in the transom 11 of the boat hull through which the housing is passed into the hull beneath decking 35 or seating mounted in the stern section of the boat. A recessed shoulder 37 that complements the shape and depth of the front wall flange of the housing is also cut into the back face of the transom permitting the housing to be flush mounted with the back face of the transom.

The housing is secured to the transom by means of square headed lag bolts 40—40 that are recessed into the flange section of the housing. The shank 41 of each lag bolt passes through the housing flange and the transom as well as a reinforcing member 43 mounted behind the transom. Each bolt includes a nut 45 and washer assembly 45 which permits the bolt to be drawn down to tightly secure the housing to the transom.

The foldable ladder 16, as noted above, contains a series of rungs 20—20 that are joined in assembly by means of two parallelly spaced cables 47—47. The back end 48 of each cable is brought through the eye of an anchor bolt 50 which is secured in the back wall of the housing. In assembly, the wire cable is looped through the bolt eye and swaged back upon itself to close the loop. A reinforcing plate 52 is mounted against the back wall of the housing and the plate is fastened to the superstructure (not shown) of the hull by tie bolts 53—53 whereby the ladder is able to support the weight of a person standing thereon. A nut and washer assembly 55 is secure the anchor bolt to both the reinforcing plate and the rear wall of the housing. Preferably, the exposed sections of the wire cables used in the ladder assembly are coated with heavy plastic to protect the boat structure and those using the ladder from sharp edges.

Each rung of the ladder is a rigid member fabricated from either plastic or wood. The two wire ladder cables are passed through each rung and the rung secured in place by means of eyelets 60—60 which are swaged or otherwise secured to the cables on either side of each rung. As noted above, the rungs are spaced apart so that they afford a secured hand hold and also permit the user to easily step from one rung to the other when climbing into and out of the boat.

The door 25 of the housing is mounted within the opening 33 by means of blind hinges 56—56 so that the door swings downwardly against the transom as shown in FIG. 2. The back side 57 of the door is provided with two spaced apart arcuate shaped channels 58 for receiving the two ladder cables when the ladder is suspended or hung from the housing as illustrated. The door, when opened, serves to hold the ladder away from the transom as it extends downwardly to the water.

When the ladder is not in use, it is retracted into the housing as shown in FIG. 3. Sufficient room is provided within the housing to accommodate all of the rung as well as the folded wire cable as shown. With the ladder stowed within the housing, the door is raised to a vertical position to close the entrance to the housing. As best illustrated in FIG. 4, the door fits flush with the front wall of the housing and is locked in place by means of a pair of wing nuts 65—65 threadably mounted in the front wall of the housing adjacent to the door. The outer periphery of the housing is generally rectangular in form, having arcuate shaped corners so that the housing gives the general appearance of a boat window. This, in conjunction with the flush mounting described above, makes the present unit extremely attractive so that it will in no way detract from the lines of the boat.

While this invention has been explained with reference to the structure disclosed herein, it is not confined to the details set forth and this application is intended to cover any modifications and changes as may come within the scope of the following claims.

What is claimed is:

1. A hidden ladder apparatus that includes a housing horizontally disposed in the transom of a boat hull above the waterline, said housing having a front wall containing an opening formed therein in coplanar alignment with said transom and a solid back wall position inside said boat hull, a foldable ladder secured to the back wall of the housing which, when folded, is fully stowed within said housing and, when extended, hangs from the housing to or below the water line, and a door for closing the opening in said housing when the ladder is stowed within said housing.

2. The apparatus of claim 1 wherein said ladder further includes a pair of flexible elongated members having spaced apart rungs secured to said members, and means for fastening one end of each member to the back wall of said housing.

3. The apparatus of claim 2 wherein the back wall of the housing further includes a reinforcing means and a eye bolt means secured to the back wall and the reinforcing means for securing each of the flexible lines to the housing.

4. The apparatus of claim 1 wherein said front wall of the housing further includes a radially disposed flange seated against the transom and fastening means for securing the flange against the transom.

5. The apparatus of claim 4 wherein said door is hinged to the housing so that it opens downwardly against the flange, said door means further includes a door panel having arcuate shaped channel means formed in the back of the panel for receiving the flexible member of the ladder therein when the ladder is suspended from the housing.

6. The apparatus of claim 5 wherein the flexible members of the ladder are formed of plastic coated wires.

7. The apparatus of claim 1 wherein said housing is cast from metal.

8. The apparatus of claim 1 wherein the housing is molded of plastic.

9. The apparatus of claim 1 that further includes weight means for holding said ladder in an extended position when it is hanging from the housing.

* * * * *